US006643870B2

(12) United States Patent
Bertrand

(10) Patent No.: US 6,643,870 B2
(45) Date of Patent: Nov. 11, 2003

(54) BLANKET

(76) Inventor: Francette Bertrand, 81 Grande Rue, La Rue Saint Pierre (FR), 60510

( * ) Notice: Subject to any disclaimer, the term of this patent is extended or adjusted under 35 U.S.C. 154(b) by 177 days.

(21) Appl. No.: 09/799,271

(22) Filed: Mar. 5, 2001

(65) Prior Publication Data

US 2001/0032360 A1 Oct. 25, 2001

(30) Foreign Application Priority Data

Mar. 7, 2000 (FR) ..... 00 02898

(51) Int. Cl.[7] ..... A47G 9/00; A41D 3/00; A41B 13/06

(52) U.S. Cl. ..... 5/482; 5/485; 5/636; 2/69; 2/69.5

(58) Field of Search ..... 5/485, 482, 636; 2/69, 69.5

(56) References Cited

U.S. PATENT DOCUMENTS

| | | | | | |
|---|---|---|---|---|---|
| 569,521 | A | * | 10/1896 | Scatchard | |
| 666,034 | A | * | 1/1901 | Solomon | |
| 2,146,400 | A | | 2/1939 | Maker et al. | 2/69 |
| 2,302,844 | A | * | 11/1942 | Ebbot | |
| 2,535,936 | A | * | 12/1950 | Langley | |
| 2,701,885 | A | * | 2/1955 | Turco | |
| 2,716,239 | A | * | 8/1955 | Barndollar | |
| 3,798,676 | A | * | 3/1974 | Shanks et al. | |
| 4,363,141 | A | | 12/1982 | Doster | 2/69.5 |
| 4,932,077 | A | * | 6/1990 | Dobbs | |
| 5,283,909 | A | | 2/1994 | Hill | 2/69 |
| 5,737,785 | A | | 4/1998 | Casey | 5/485 |
| 5,970,542 | A | | 10/1999 | Mays | 5/485 |

FOREIGN PATENT DOCUMENTS

| | | |
|---|---|---|
| DE | 88 08 150 U | 10/1988 |

* cited by examiner

*Primary Examiner*—Alexander Grosz
(74) *Attorney, Agent, or Firm*—Pearne & Gordon LLP

(57) ABSTRACT

The invention relates to a blanket to cover the chest (11), arms (12) and legs (13) of a person in the seated, lying down or partly lying down position, comprising a lower inner pocket (20) to contain the legs of the said person, this lower inner pocket (20) being formed from the lower central part of the blanket (10).

26 Claims, 6 Drawing Sheets

BLANKET

TECHNICAL FIELD

The present invention relates to a blanket to surround the chest, arms and legs of a person in the seated, lying down or partly lying down position.

STATE OF PRIOR ART

The use of a blanket, for example a woollen blanket, to protect a person from the cold or the weather, has been known for a long time. Thus, it is frequent that a person who suffers from the cold, for example an elderly person, or for a person who would like to watch the television or read a book comfortably, while relaxing in a seated, lying down or partly lying down position, for example on a reclining armchair, would protect himself or herself using this type of blanket, to stay warm and cosy.

Unfortunately, this type of blanket is not easy to put into position. Furthermore, it tends to slide away or even slide when the person makes small movements, for example while sleeping.

The fact of being obliged to regularly reposition the said blanket is annoying, and it may also be difficult, particularly in the case of a sick or elderly person, or simply someone who is sleepy.

A document of the prior art, U.S. Pat. No. 4,916,756, describes a blanket designed to solve this type of disadvantage. The blanket is formed from a first square piece of blanket in which one of the corners is removed along a 45° direction. A second piece of blanket is then sewn on the inner part of the blanket to form a pocket that could hold the feet of a person lying down under this blanket. But firstly, the corner opposite the pocket must be folded to avoid covering the face of this person, and secondly there is nothing to stop this blanket from sliding over the knees or even the feet of a person who is moving.

The object of the invention is a blanket that does not have these drawbacks.

DISCLOSURE OF THE INVENTION

The present invention proposes a blanket to surround the chest, arms and legs of a person in a seated, lying down or partly lying down position while preventing this blanket from sliding, this blanket comprising a lower inner pocket to contain the feet of the said person, in which this lower inner pocket is formed from a lower central part of the blanket, and in which the said blanket also comprises a median inner pocket fitted with two side openings for the hands of the said person, and means of holding the said blanket in place around the neck of the said person.

Advantageously, the lower inner pocket is part of the blanket folded on itself and fixed on each side; the two side lower parts having been removed.

Advantageously, the said blanket may also comprise a median outer pocket, either for the hands or to place different small objects such as a handkerchief, a book, spectacles, a remote control, etc., and possibly fastening means placed on each side of the blanket to hold the blanket in place.

The pockets, like the lower inner pocket, may be made using VELCRO strips (deposited trademark), press studs, slide fasteners, etc.

Advantageously, the blanket comprises at least two openings on each side of the median inner pocket through which the hands can pass.

Advantageously, holding means may consist of a slit formed in the upper part of the said blanket, or two strips connected to this upper part.

In one variant embodiment, the lower inner pocket is removable. It may then be formed from two superposed half pockets, for example with different colours.

Heating elements may be added to the lower inner pocket.

Advantageously, the lower inner pocket forms an envelope, in which the entire said blanket can be stored when folded to form a "pillow".

The blanket according to the invention may be made of wool, cotton, towelling, skai, oilcloth or any other appropriate material.

Unlike U.S. Pat. No. 4,916,756, the blanket according to the invention only needs one rectangular piece of material, the lower central part of the blanket being folded on itself before being fixed on each side to form a lower inner pocket for the feet. The two rectangular parts that may be removed on each side of this lower pocket may be used to make the two inner and outer median pockets.

Therefore, the blanket according to the invention has many advantages compared with the blanket described in U.S. Pat. No. 4,916,756. In fact it is very easy to:

- make it: only one rectangular piece of material is necessary,
- store it: it can be folded in the form of a pillow,
- use it: there is no risk of it dropping off even with restless persons.

Moreover, the cost of making this type of blanket is very low.

There can be many applications for this type of blanket, particularly as:

- a blanket for use at home (for example for watching the television, etc.),
- a travelling blanket for use in aircraft, trains, etc.,
- a blanket used for sick or elderly persons, for example in a retirement home,
- a child's blanket in a pushchair,
- a blanket to cover a wheelchair for a handicapped person (can be made from skai, oilcloth, etc.),
- blanket made of towelling for beach wear,
- etc.

DETAILED DESCRIPTION OF PARTICULAR EMBODIMENTS

Figure 1:
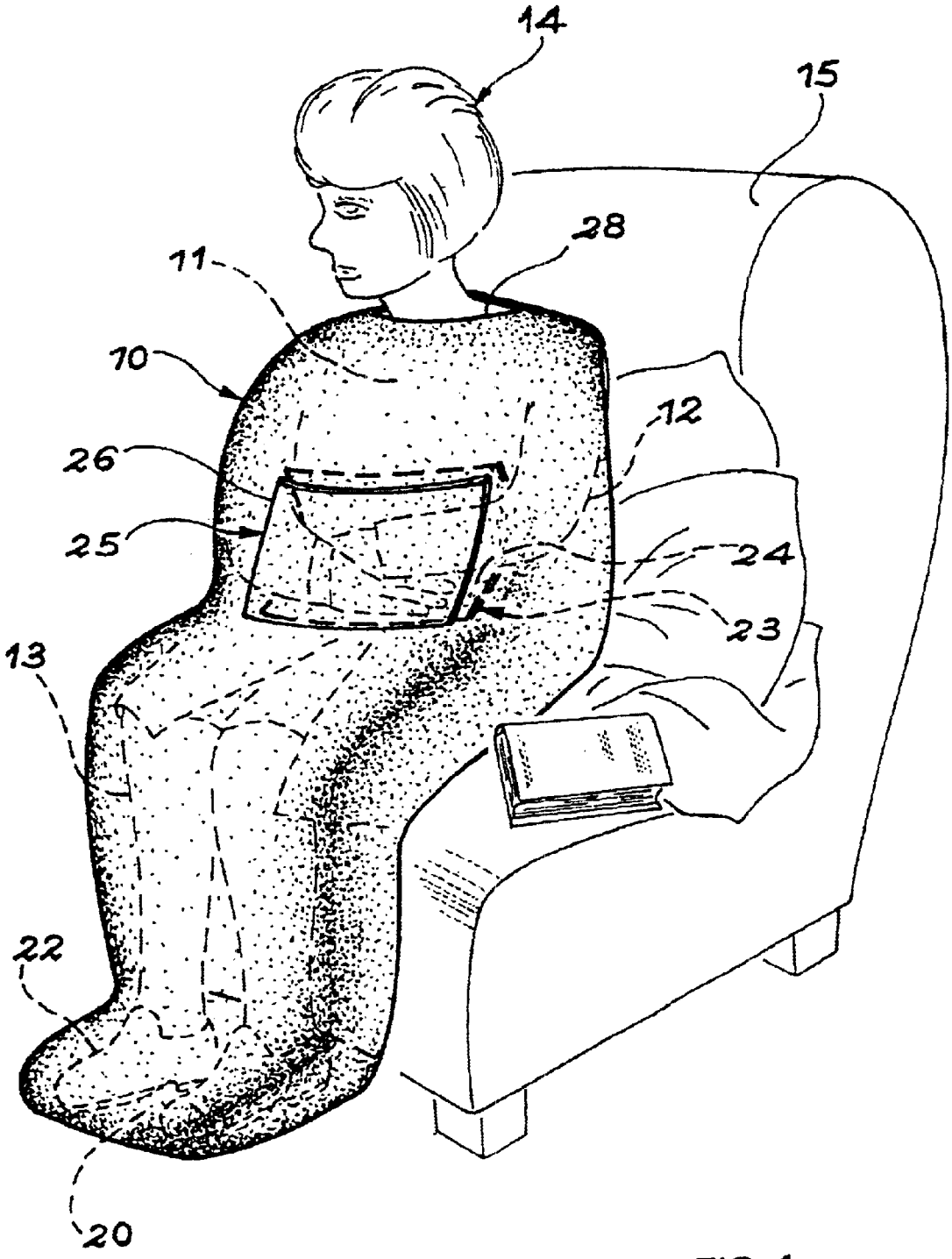
FIG. 1 illustrates the blanket according to the invention placed on the body of a person in the seated position.

The blanket 10 according to the invention, as illustrated in FIG. 1, surrounds the chest 11, the arms 12 and the legs 13 of a person 14 resting on a seat 15, in the seated position in the figure.

This blanket 10 comprises a lower inner pocket 20 provided with an upper opening 21 to contain the feet 22, a median inner pocket 23 with two side openings 24 for the hands possibly with a median outer pocket 25, for example with two side openings 26 or possibly an upper opening, in which small frequently used objects such as a handkerchief, spectacles, a remote control, a book, etc., can be placed, means 29 of holding the said blanket around the neck and possibly fastening means 27.

For example, the holding means 29 may consist of ties passed through at least two button holes to attach them behind the person's neck.

For example, the fastening means 27 may be small braided fasteners made of lace or other, etc., placed on the two sides of the blanket in at least one location, for example in two locations on each side, in order to fix the blanket to a bed, a seat, a deckchair or other, etc., for example for a sick or disabled person. Laces may also be sewn at their midpoint so that the blanket can be tied to the bed, the seat or to the deckchair and prevent it from flying away. A button hole may also be provided close to the edge of the blanket at the point at which each of these laces is attached, this button hole being about 1 to 2 cm long, through which a folded lace forming a loop is inserted, and the free ends of this lace are passed into the loop in order to make a "sliding" knot that passes around the edge of the blanket and in the said button hole.

Closing means (VELCRO (registered trademark) strip or other) may be provided in the median inner pocket 23 to make a safe "hiding place" for example for money, cards, check books for use as an aircraft travelling blanket.

A slide fastener may also be provided in the upper part of the median outer pocket 25 to facilitate access to objects contained in it such as a handkerchief, spectacles, a remote control, a book, etc.

Openings 49 may also be provided in one variant embodiment in the shape of a slit in the blanket on each side of the median pocket(s) (23, 25), on each side, and/or above and below this or these pockets. These openings 49 may or may not be inclined. The person inside the blanket can pass his or her hands through these openings 49 to read, use a remote control, blow his or her nose, or eat from a tray, etc.

In one variant embodiment, the lower inner pocket 20 may be cut and added onto the blanket. It may be removable, for example by using a VELCRO strip 50, a slide fastener (zipper or other, made of metal or plastic), press studs or any other assembly means. For a blanket used in an aircraft, train, bus, boat or anywhere else, etc., if an accident occurs, this pocket 20 can be torn off to release the legs. Advantageously, there may be two half pockets superposed in this pocket 20. In this case, two different matching colours can be used; the top can be one colour and the bottom can be another colour.

In another variant embodiment, heating means may be added to this pocket 20 (for example below it), these means being removable since the blanket must be washed.

Figure 2:
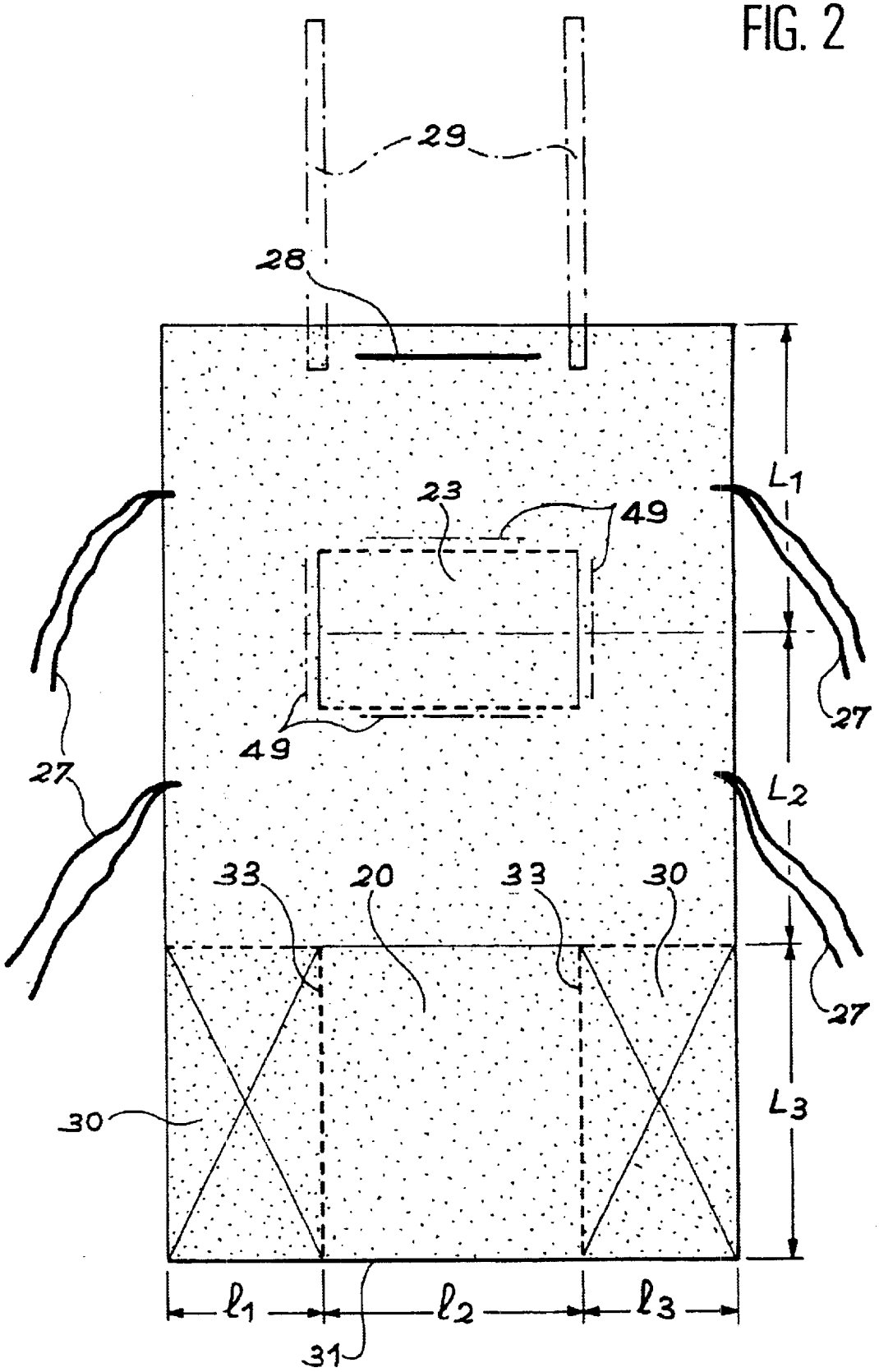
FIG. 2 illustrates a rectangular piece of material before it was formed into a blanket according to the invention, after making the lower pocket.
Figure 3:
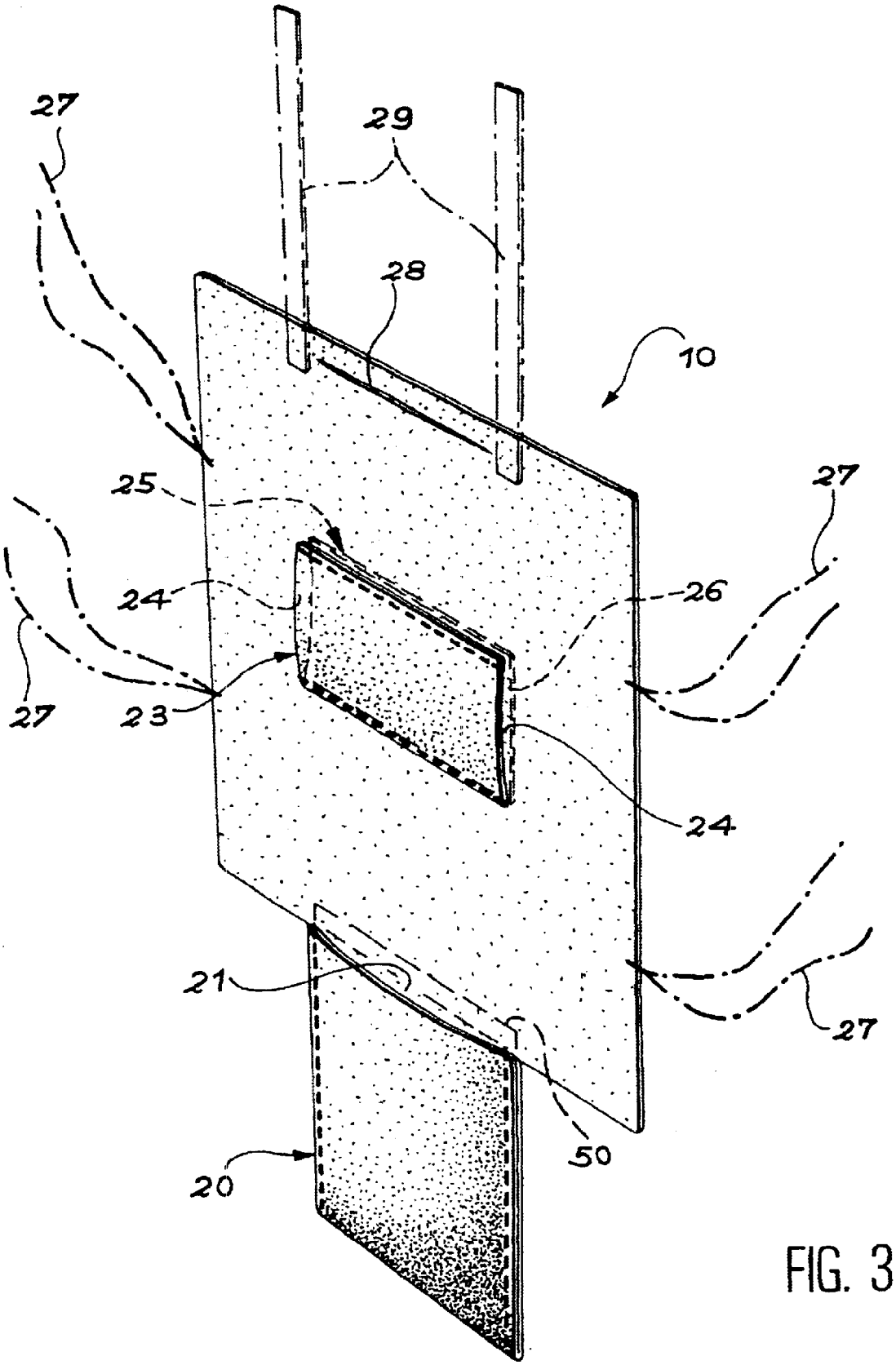
FIG. 3 illustrates the blanket according to the invention in the unfolded position.

As illustrated in FIGS. 2 and 3, this type of blanket can be made starting from a rectangular piece of material made of wool, cotton, synthetic material or any other suitable material, in which the lower part is folded along a line 31 to form a central pocket 20 for the feet fixing them on the sides 33, for example by sewing it or fixing it with VELCRO strips (registered trademark), slide fasteners, press studs, etc., and the two rectangular lower parts 30 are cut out. Furthermore, a median inner pocket 23 and a median outer pocket 25 are fixed using fastening means like those mentioned above. Holding means may then be provided around the neck by cutting a longitudinal slit 28 in the upper part of the blanket 10 or by providing strips 29 connected to this upper part, that can be attached around the neck.

It is also advantageous to use waste material consisting of parts 30 to make the pockets 23 and 25 and the strips 29.

Figure 4:
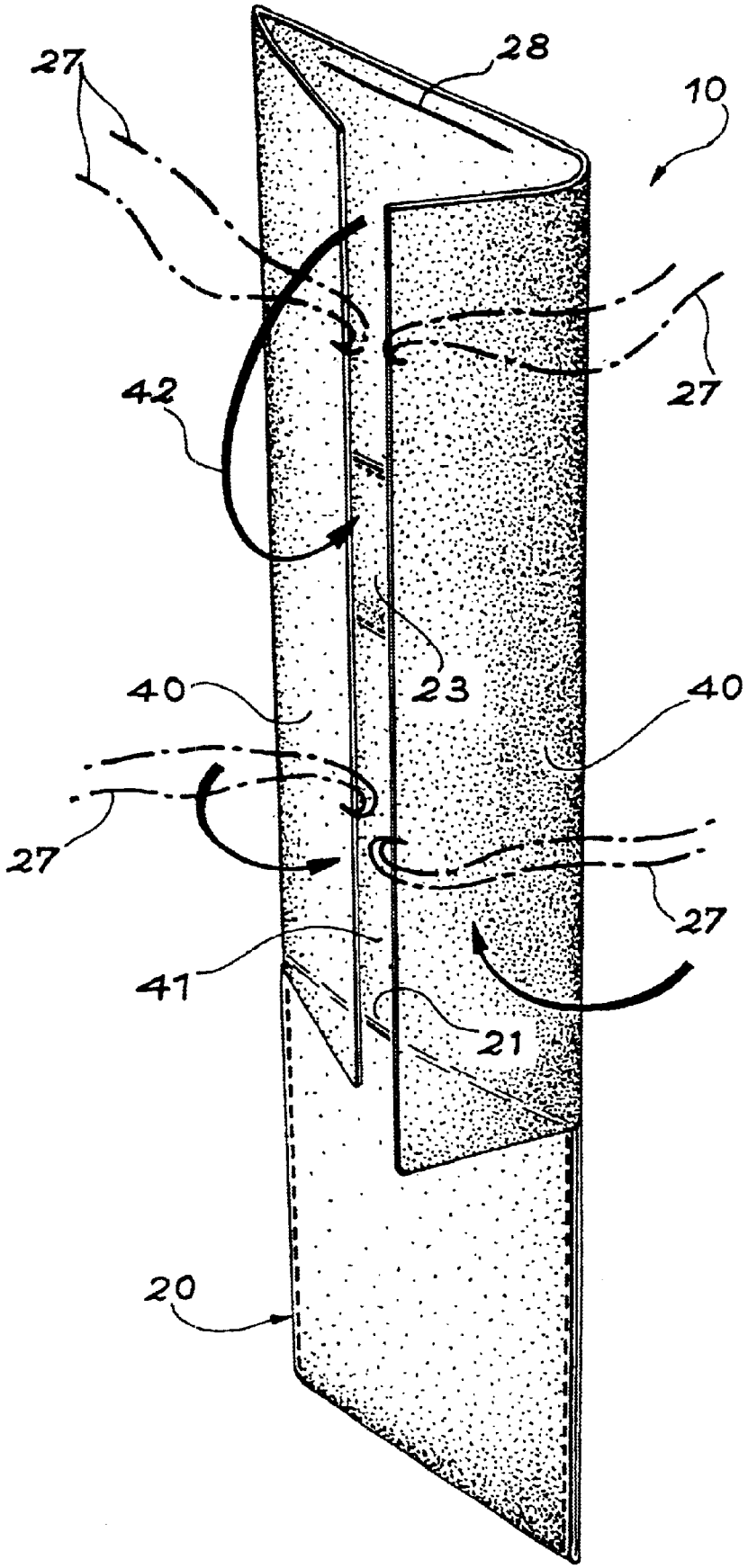
FIG. 4 illustrates how the blanket according to the invention is folded.
Figure 5:
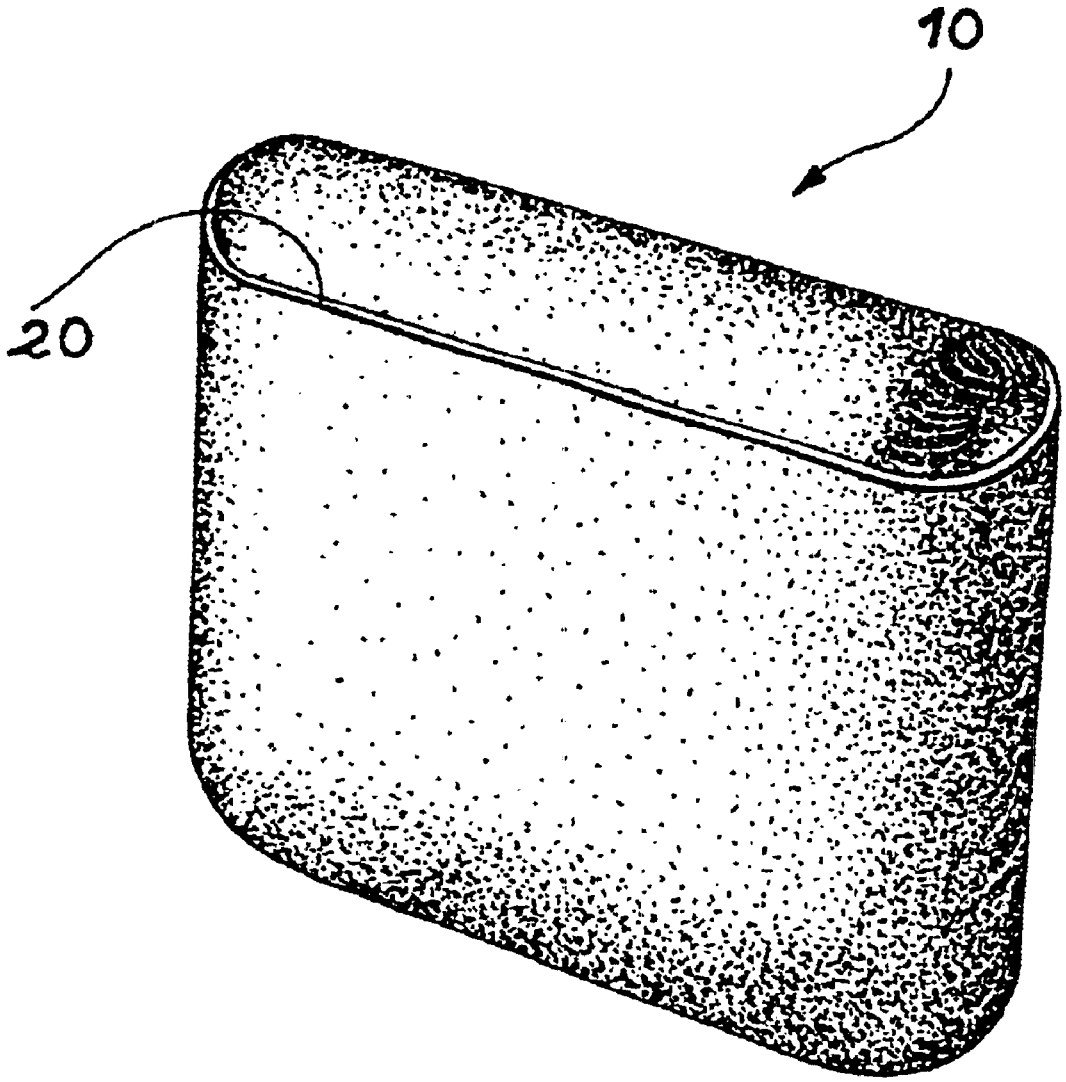
FIG. 5 illustrates the pillow obtained after folding according to FIG. 4.
Figure 6:
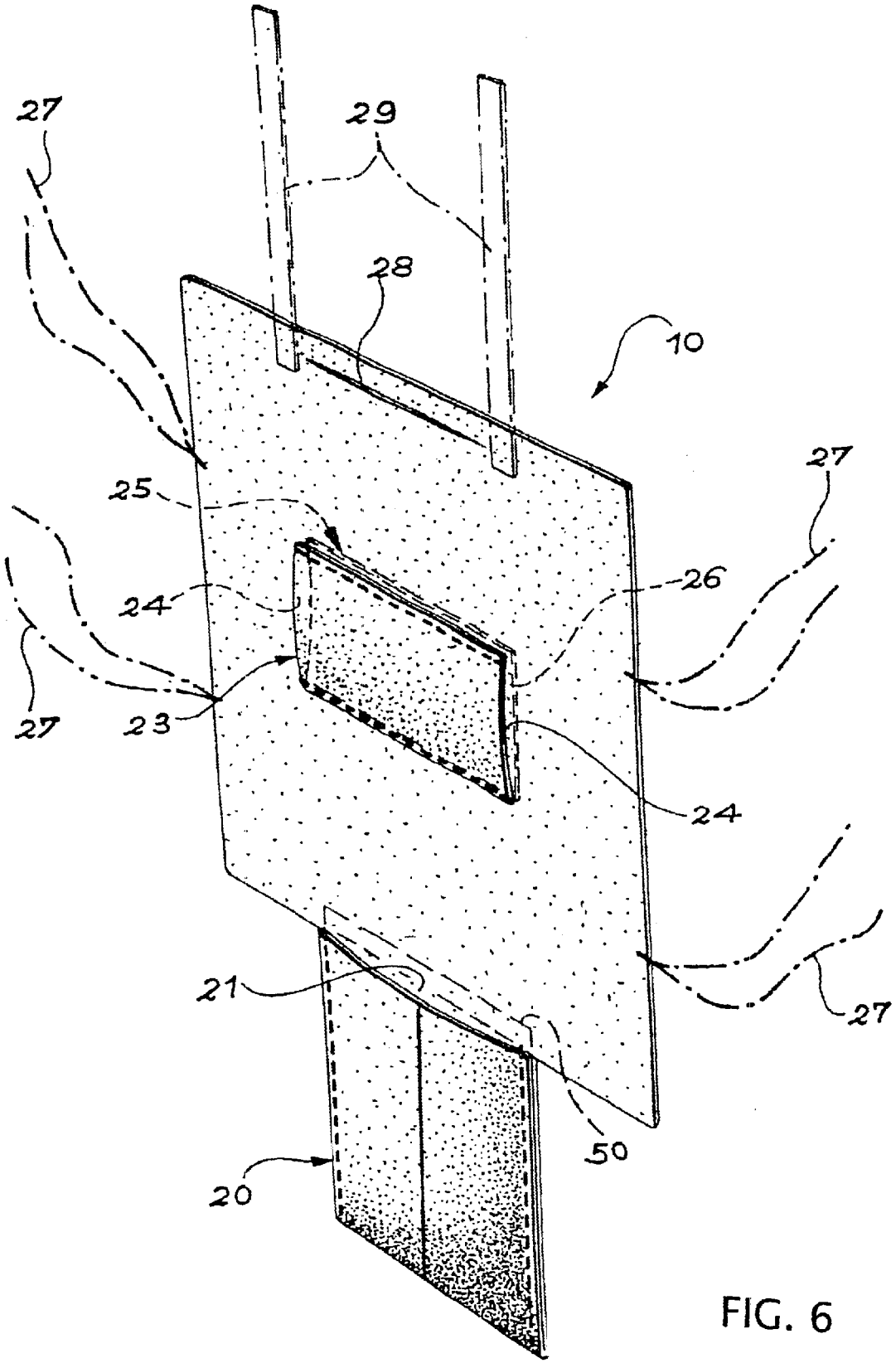
FIG. 6 illustrates the blanket having two superposed half pockets disposed within the lower pocket according to an embodiment of the present invention, the blanket being in the unfolded position.

As illustrated in FIG. 4, the blanket according to the invention may be folded firstly by folding the edges 40 of the blanket on its central part 41 and then folding the assembly 42 and inserting it into the lower inner pocket 20 to form a "pillow" as illustrated in FIG. 5.

The following dimensions could be used in one example embodiment, illustrated in FIG. 2:

widths: 11=13=0.25 m; 12=0.50 m total width=11+12+13=1 m lengths: L1=L2=L3=0.60 m total length=L1+L2+2 L3=2.40 m longitudinal slit 28 between 25 and 30 cm long, cut between 15 and 20 cm from the top edge of the blanket 10, to fit comfortably over the shoulders 14 to 18 cm long openings 49 on each side of the median pockets 23, 25.

What is claimed is:

1. A blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side opening for the hands of the person, and means for holding the blanket in place around the neck of the person, wherein the lower inner pocket is part of the blanket folded on itself and fixed on each side, the two side lower parts having been removed.

2. The blanket according to claim 1 further comprising fastening means placed on each side of the blanket to hold the blanket in place.

3. The blanket according to claim 2, wherein the fastening means consist of laces sewn at their midpoint in at least one location, on each side of the blanket.

4. The blanket according to claim 1, further comprising at least two openings on each side of the median inner pocket.

5. Blanket according to claim 4 comprising four openings, one on each side of the inner median pocket, one above it and one below it.

6. The blanket according to claim 1, wherein the inner median pocket is provided with closing means to make a safe hiding place.

7. The blanket according to claim 1, wherein each pocket is fixed to the blanket by stitching or by hook and loop type fastener strips, press studs or slide fasteners.

8. The blanket according to claim 1, wherein the holding means comprises a slit formed in the top part of the blanket.

9. The blanket according to claim 1, wherein the holding means comprises at least two strips fastened to the top part of the blanket.

10. The blanket according to claim 1, wherein the lower inner pocket is formed of two superposed half pockets.

11. The blanket according to claim 1, wherein heating elements are added to the inner lower pocket.

12. The blanket according to claim 1, wherein the blanket is made of wool, cotton, towelling, skai, or oilcloth.

13. A Blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side opening for the bands of the person, and means for holding the blanket in place around the neck of the person, and an outer median pocket provided with two side openings.

14. A blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side openings for the hands of the person, and means of holding the blanket in place around the neck of the person, wherein the lower inner pocket is cut and added in a removable manner onto the blanket.

15. A blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side openings for the hands of the person, and means for holding the blanket in place around the neck of the person, wherein the lower inner pocket forms an envelope having a plurality of closed ends and an open end through which the entire blanket can pass when it is folded, to form a pillow.

16. A blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side openings for the hands of the person, fastening means placed on each side of the blanket to hold the blanket in place, and means for holding the blanket in place around the neck of the person, wherein the lower inner pocket is cut and added into the blanket.

17. The blanket according to claim 16 further comprising at least two openings on each side of the median inner pocket.

18. The blanket according to claim 17 further comprising four openings, one on each side of the inner median pocket, one above it and one below it.

19. The blanket according to claim 16, wherein the inner median pocket is provided with closing means to make a safe hiding place.

20. The blanket according to claim 16, wherein each pocket is fixed to the blanket by stitching or by hook and loop type fastener strips, press studs or slide fasteners.

21. The blanket according to claim 16, wherein the holding means comprise at least two strips fastened to the top part of the blanket.

22. The blanket according to claim 16, further comprising fastening means including laces sewn at their mid-point in at least on location, on each side of the blanket.

23. The blanket according to claim 16, wherein the lower inner pocket is formed of two superposed half pockets.

24. The blanket according to claim 16, wherein heating elements are added to the inner lower pocket.

25. The blanket according to claim 16, wherein the blanket is made of wool, cotton, towelling, skai, oilcloth, or any other suitable material.

26. A blanket to surround the chest, arms and legs of a person in a seated, lying down or partly lying down position while preventing this blanket from sliding, this blanket comprising a lower inner pocket to contain the feet of the person, wherein this lower inner pocket is formed from a lower central part of the blanket, the blanket further comprising a median inner pocket fitted with two side openings for the hands of the person, and means for holding the blanket in place around the neck of the person, wherein the holding means comprises a longitudinal slit cut in the top part of said blanket.

* * * * *

UNITED STATES PATENT AND TRADEMARK OFFICE

CERTIFICATE OF CORRECTION

PATENT NO. : 6,643,870 B2
DATED : November 11, 2003
INVENTOR(S) : Francette Bertrand It is certified that error appears in the above-identified patent and that said Letters Patent is hereby corrected as shown below:

Column 5,
Line 5, please delete “bands”, and insert therefor -- hands --.

Column 6,
Line 19, please delete “at least on location”, and insert therefor
-- at least one location --.

Signed and Sealed this

Twentieth Day of April, 2004

JON W. DUDAS
*Acting Director of the United States Patent and Trademark Office*